US009359107B2

(12) United States Patent
Glass et al.

(10) Patent No.: US 9,359,107 B2
(45) Date of Patent: Jun. 7, 2016

(54) CARD READER ACCESSIBLE MULTIPLE TRANSACTION CARD HOLDER

(71) Applicant: Gift Card Impressions, LLC, Kansas City, MO (US)

(72) Inventors: Brett R. Glass, Kansas City, MO (US); Nicole E. Glass, Kansas City, MO (US)

(73) Assignee: Gift Card Impressions, LLC, Kansas City, MO (US)

( * ) Notice: Subject to any disclaimer, the term of this patent is extended or adjusted under 35 U.S.C. 154(b) by 401 days.

(21) Appl. No.: 13/734,881

(22) Filed: Jan. 4, 2013

(65) Prior Publication Data

US 2013/0186788 A1 Jul. 25, 2013

Related U.S. Application Data

(60) Provisional application No. 61/582,987, filed on Jan. 4, 2012.

(51) Int. Cl.

| | |
|---|---|
| ***B65D 85/48*** | (2006.01) |
| ***B65D 13/00*** | (2006.01) |
| ***B65D 73/00*** | (2006.01) |

(52) U.S. Cl.

CPC ..... *B65D 13/00* (2013.01); *B65D 73/0085* (2013.01)

(58) Field of Classification Search

CPC ..... B65D 13/00; B65D 73/0085; B42F 17/02

USPC ..... 206/37–39, 232, 425, 449, 461, 467, 206/469, 470, 471, 806; 40/124.06, 124.09, 40/124.11; 229/92.1, 92.8; 235/380, 486

See application file for complete search history.

(56) References Cited

U.S. PATENT DOCUMENTS

| | | | | |
|---|---|---|---|---|
| 5,593,036 | A * | 1/1997 | Dyble et al. | 206/464 |
| 6,073,379 | A * | 6/2000 | Boyce | 40/124.06 |
| 7,374,095 | B2 * | 5/2008 | Blank et al. | 235/380 |
| 7,861,441 | B1 * | 1/2011 | Hoellwarth | 40/124.06 |
| 8,181,789 | B1 * | 5/2012 | Casella et al. | 206/471 |
| 8,584,841 | B1 * | 11/2013 | Tiegs | 206/471 |
| 2008/0116088 | A1 * | 5/2008 | Roberts | 206/232 |
| 2009/0218392 | A1 * | 9/2009 | Biskupski et al. | 235/375 |
| 2009/0283594 | A1 * | 11/2009 | Walton et al. | 235/383 |
| 2010/0219099 | A1 * | 9/2010 | Schmitt et al. | 206/39 |

* cited by examiner

*Primary Examiner* — Luan K Bui

(74) *Attorney, Agent, or Firm* — Polsinelli PC

(57) ABSTRACT

A card holder assembly for holding multiple transaction cards, such as gift cards, to a common backer panel for presentation and sale. Cards mounted on the backer panel may be lifted for scanning by a card reader without necessitating removal of the cards from the assembly.

12 Claims, 20 Drawing Sheets

Fig. 40
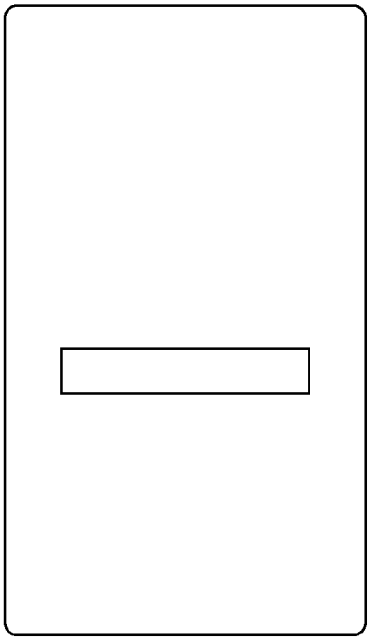
Fig. 41
Fig. 42
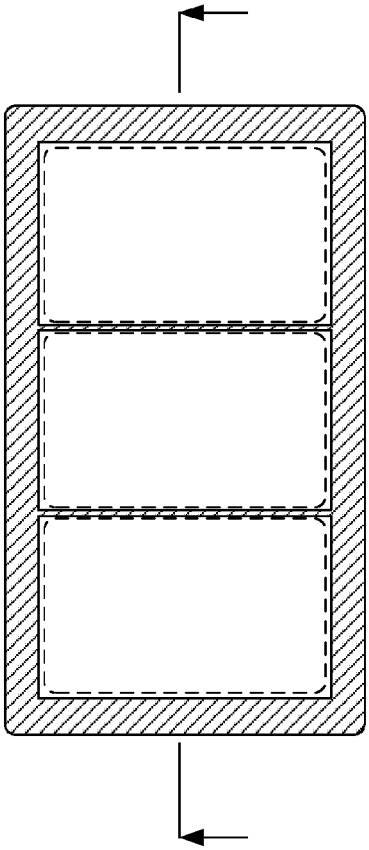
Fig. 43
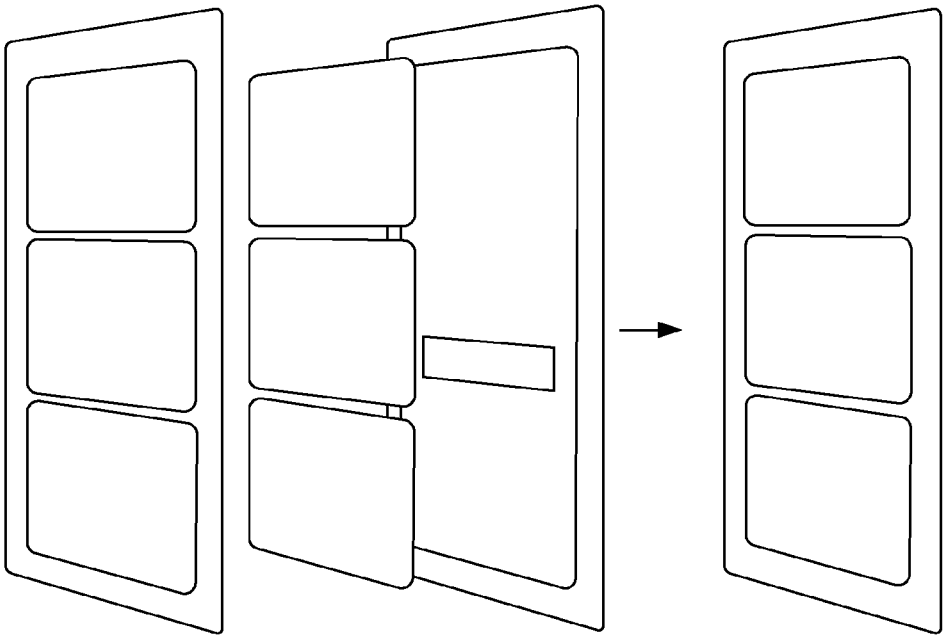

CARD READER ACCESSIBLE MULTIPLE TRANSACTION CARD HOLDER

CROSS REFERENCE TO RELATED APPLICATIONS

This application claims the benefit of the prior filed, provisional application Ser. No. 61/582,987, filed Jan. 4, 2012, incorporated by reference herein.

BACKGROUND OF THE INVENTION

This invention relates generally to transaction card holders and more particularly to a card holder for holding multiple transaction cards, such as gift cards, within an assembly that allows the cards to be scanned by a card reader without detachment from the holder.

Transaction cards, stored value cards, or gift cards, as they are commonly called, based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or may be selected at the point of sale by the purchaser and loaded by the cashier using a magnetic card reader/writer. As an alternative to a magnetic strip, a transaction card may use a bar code to link the card to an account by which the associated value is stored in a computer database. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets. What is needed is a device for displaying multiple cards in an integrated package that also allows for scanning of each card without detachment from the package.

BRIEF DESCRIPTION OF THE INVENTION

The purpose of this invention is to provide a card holder assembly for holding multiple transaction cards, such as gift cards, to a common backer panel for presentation and sale. The assembly provides certain structures for enabling cards held thereto to be lifted away from the assembly for scanning by a card reader without necessitating removal of the cards. The assembly also provides for bundling and sale of multiple cards associated with multiple different vendors in one unit. An embodiment of the card holder assembly may include a backer panel, foldable tabs for holding transaction cards thereto, and envelopes corresponding to each card and also attached to the assembly for later use by a purchaser.

Other advantages of the invention will become apparent from the following description taken in connection with the accompanying drawings, wherein is set forth by way of illustration and example an embodiment of the present invention.

BRIEF DESCRIPTION OF THE DRAWINGS

FIG. 40 is a front elevation view of a backer panel typically comprising cardboard or heavy paper and used for single or parent card activation.

FIG. 41 is cross sectional view of the cover of FIG. 42.

FIG. 42 is a rear view of a clamshell cover typically comprising clear, molded polyvinyl chloride, acetate, or PETG, the shaded portions indicating adhesive for adhering the cover to the backer panel of FIG. 40.

FIG. 43 is a diagram showing assembly of a cover, transaction cards and backer panel.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
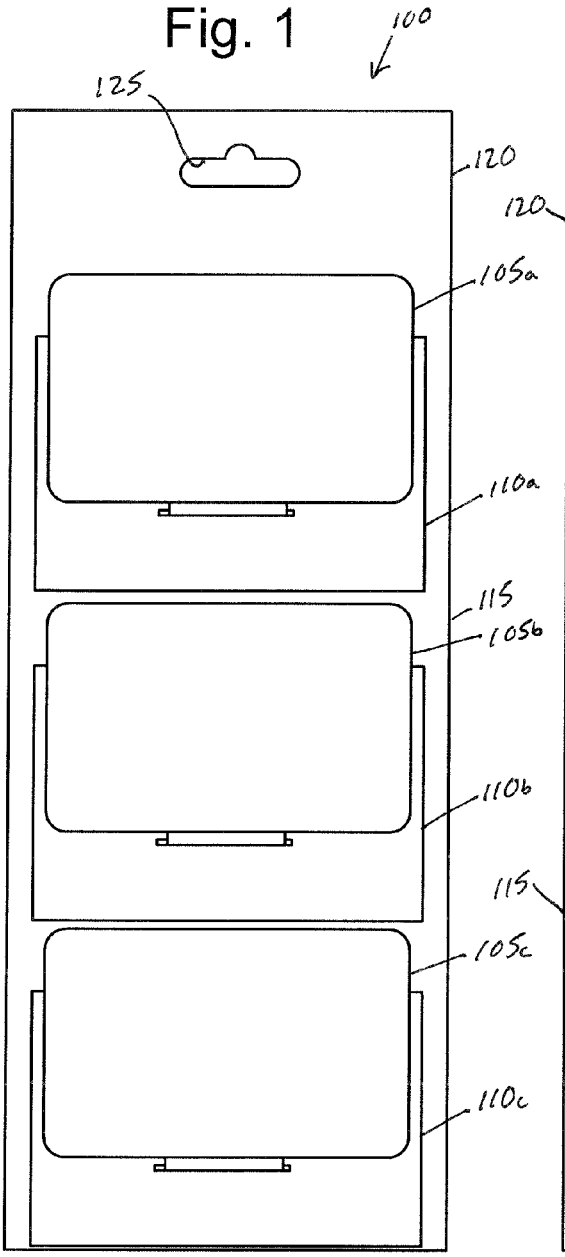
FIG. 1 is a front elevation view of a holder showing envelopes and transaction cards attached to the front surface of the backer panel.
Figure 2:
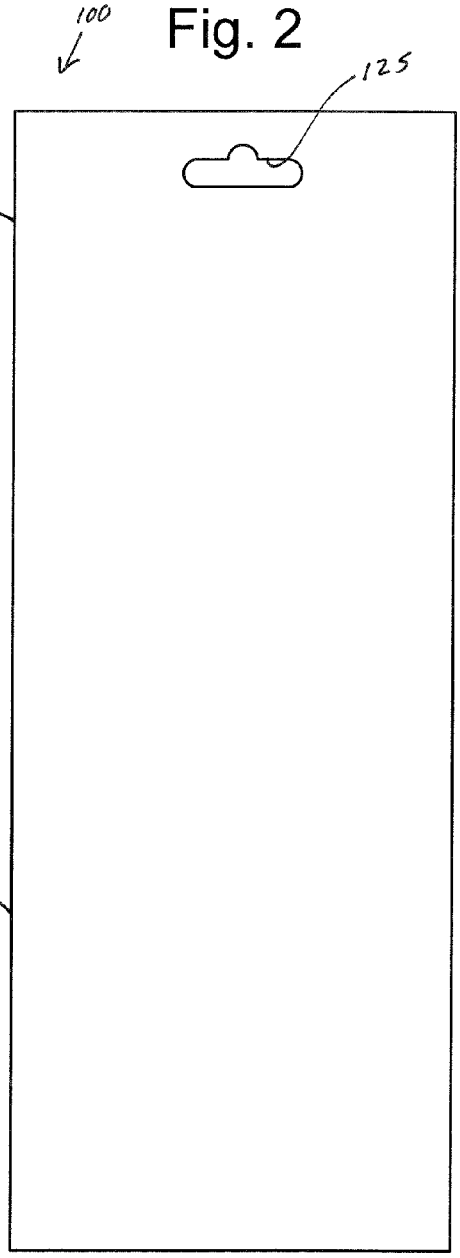
FIG. 2 is a rear elevation view of a holder showing the rear surface of the backer panel.

With reference to the figures, FIGS. 1-21 illustrate one or more embodiments of a card holder assembly 100 for holding multiple transaction cards 105 (such as gift cards) and corresponding envelopes 110. The holder assembly 100 includes a backer panel 115 to which the cards 105 and envelopes 110 are removably attached. FIG. 1 is a front elevation view of a card holder 100 showing transaction cards 105 and envelopes 110 attached to the front surface of the backer panel 115. FIG. 2 is a rear elevation view of the holder assembly 100 showing the rear surface of the backer panel 115. As illustrated, the backer panel 115 includes an upper header portion 120 having a centrally located aperture or peg hole 125 for receiving the peg of a product display stand (not shown).

Figure 3:
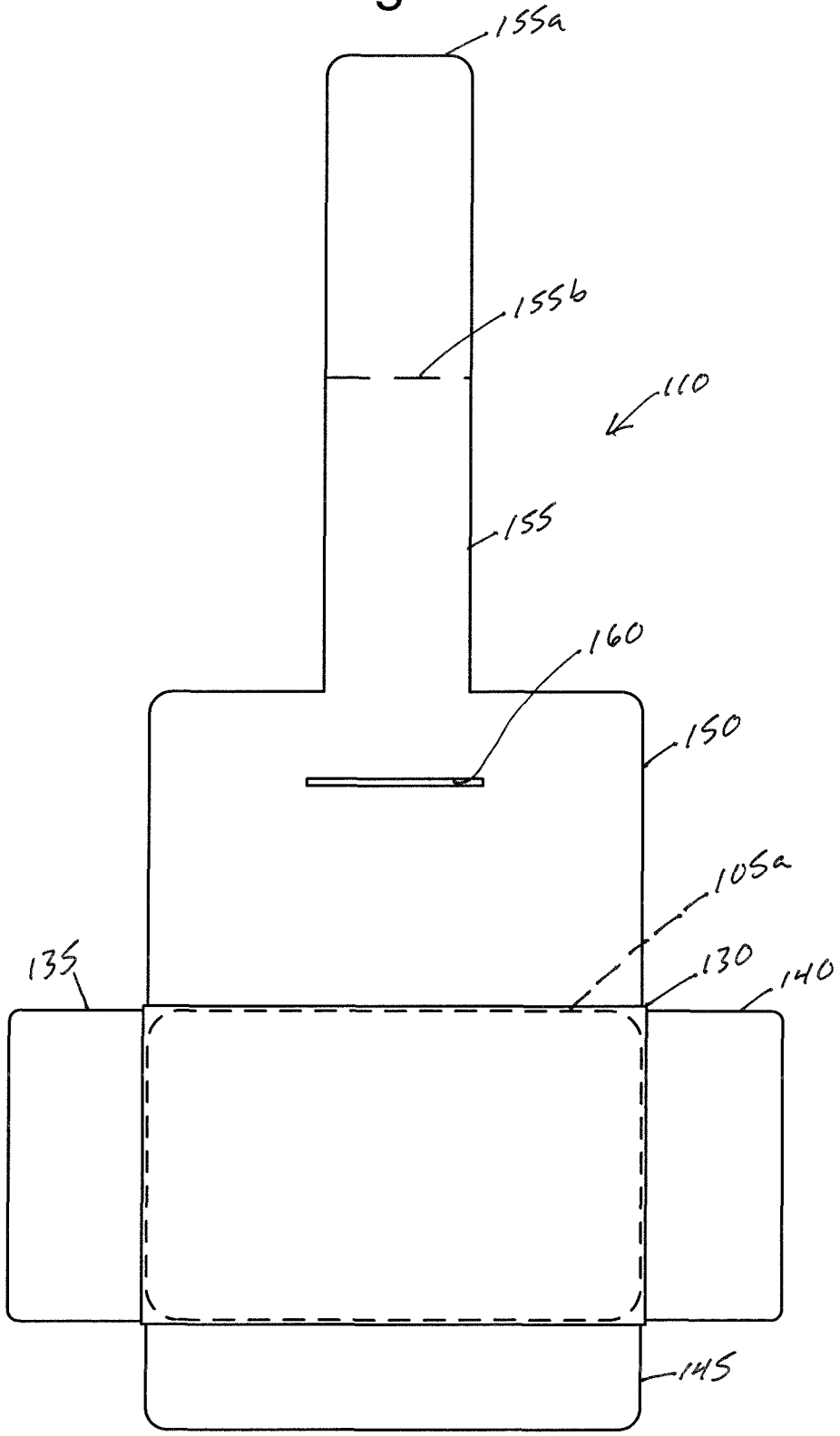
FIG. 3 is a plan view of an envelope in an unfolded disposition also showing positioning of a transaction card in phantom lines.

FIG. 3 is a plan view of an envelope 110 in an unfolded disposition. The envelope 110 includes a main panel 130, a first side flap 135 projecting from the left margin of the main panel 130, a second side flap 140 projecting from the right margin of the main panel 130, a bottom flap 145 projecting from the bottom margin of the main panel 130, and a top flap 150 projecting from the top margin of the main panel 130. The flaps 135, 140, 145 and 150 are hingedly connected to the main panel 130, typically via pre-scored fold lines therebetween, when the envelope 110 comprises a single piece of paper, card stock, or the like. The fold lines are typically formed by folding the flaps relative to the main panel 130 during assembly. The main panel 130 and flaps 135, 140, 145 and 150 extending therefrom comprise an envelope main body 111.

A tongue or strap 155 further projects from a top margin of the top flap 150 and may be likewise hingedly connected thereto along a fold line. The intended position or location of a transaction card 105 within the envelope 110 is shown in phantom lines. The top flap 150 includes an envelope slot 160 for receiving the distal end 155*a* of the tongue 155 after the tongue 155 is wrapped around the envelope 110 to secure the envelope 110 in a closed position, as described below. The tongue 155 may be provided with one or more pre-scored fold lines 155*b* to correspond to folds made in the tongue 155 when it is wrapped around the envelope 110 and/or secured to the backer panel 115. Alternatively, such folds may be made by bending the tongue 155 in the appropriate locations during assembly.

Figure 6:
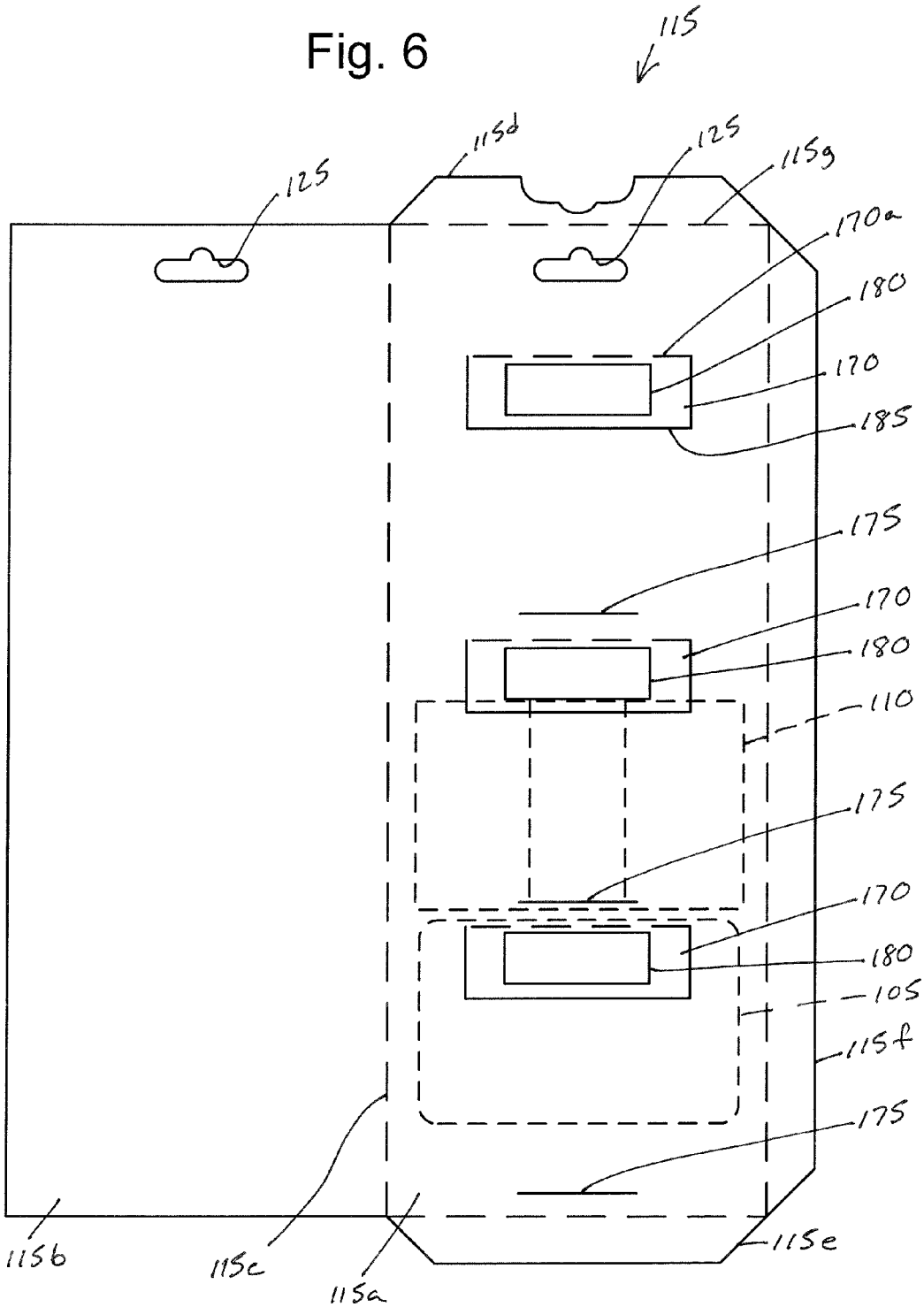
FIG. 6 is an elevation view of a backer panel in an unfolded disposition showing the backer panel front subpanel and rear subpanel joined to one another along an elongated, longitudinal hinge line, attachment flaps projecting from the top, bottom and side margins of the front subpanel, as well as transaction card and envelope positioning.

Turning to the structure of the backer panel 115, FIG. 6 is an elevation view of a backer panel 115 in an unfolded disposition showing the backer panel front subpanel 115*a* and rear subpanel 115*b* joined to one another along an elongated, longitudinal hinge line 115*c*. A top attachment flap 115*d* projects upward from the top margin of the front subpanel 115*a*. A bottom attachment flap 115*e* projects downward from the bottom margin of the front subpanel 115*a*. A side attachment flap 115*f* projects rightward (as illustrated) from the side of the front subpanel 115*a* distal to the hinge line 115*c*.

The front subpanel 115*a* illustrated in FIG. 6 includes three pairs of foldable, backer panel tabs 170 and backer panel slits 175 to accommodate attachment of three pairs of transaction cards 105 and associated envelopes 110. Each tab 170 is cut on three contiguous sides from the material of the front subpanel 115*a* to form a structure that may either lie in the plane of the backer panel 115 or be folded away from the plane of the backer panel 115 by rotating or bending the tab 170 along a top fold line 170*a*. Removable adhesive 180 is applied to the front surface of each of the tabs 170 to adhere a card 105 to each tab 170 after the envelopes 110 are attached as shown in FIGS. 7 through 10.

To assemble the backer panel 115, adhesive is applied to the forward faces of flaps 115*d*, 115*e* and 115*f* and the flaps are folded back along fold lines 115*g* to lie behind the front subpanel 115*a*. The rear subpanel 115*b* is then folded backwards along hinge line 115*c* until it contacts and adheres to the flaps.

Figure 7:
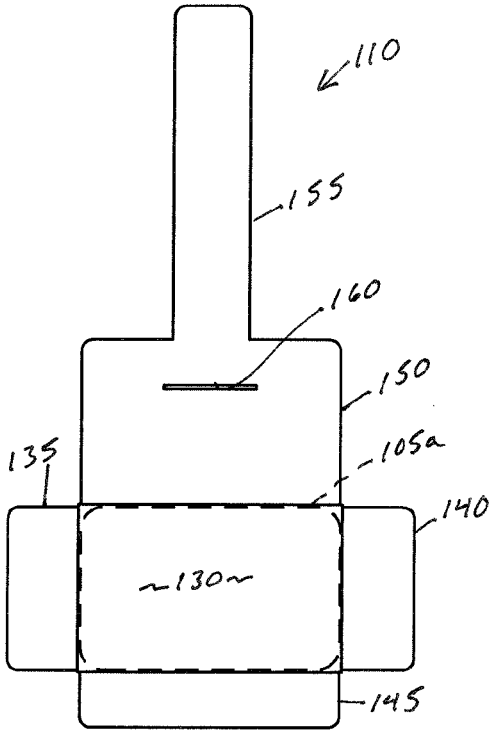
FIGS. 7 through 10 are a progression of images showing steps in the process of folding an envelope prior to installing the envelope upon the backer panel.
Figure 8:
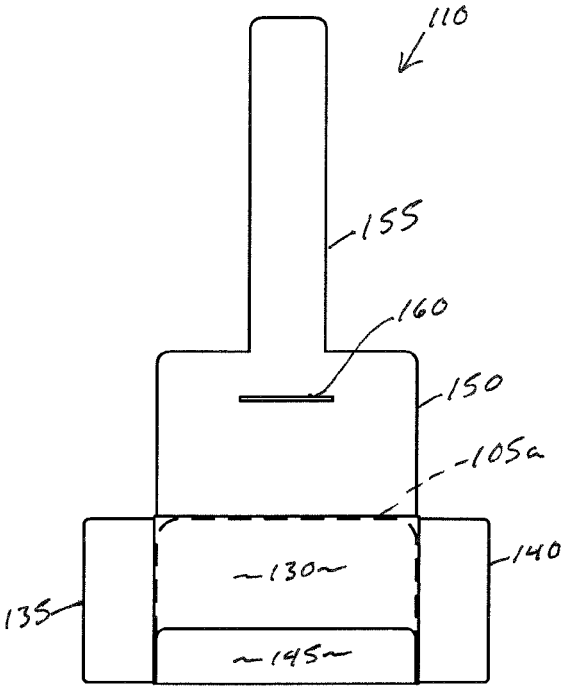
Figure 9:
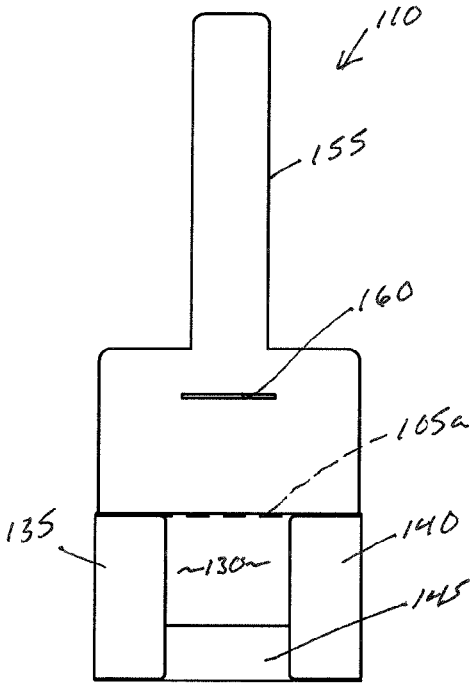
Figure 10:
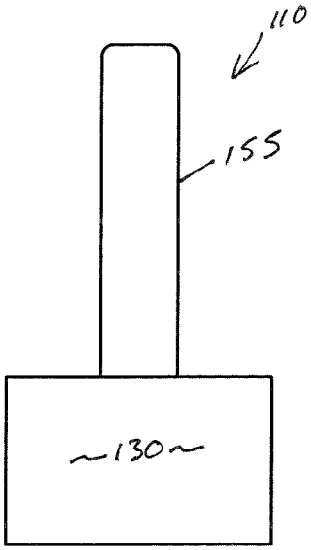

FIGS. 7 through 17 are a progression of images showing the folding, positioning and attachment of envelopes 110 upon a backer panel 115, in sequence. FIGS. 7 through 10 are a progression of images showing steps in the process of folding an envelope 110 prior to installing the envelope 110 upon the backer panel 115. FIG. 7 is a plan view of an envelope 110 in an unfolded disposition. FIG. 8 shows the bottom flap 145 folded inward and upward upon the main panel 130. FIG. 9 shows the side flaps 135 and 140 folded inward and upon the main panel 130. FIG. 10 shows the main panel 130 folded upward and upon the top flap 150, such that the back surface of the main panel 130 is facing upward in FIG. 10.

Figure 11:
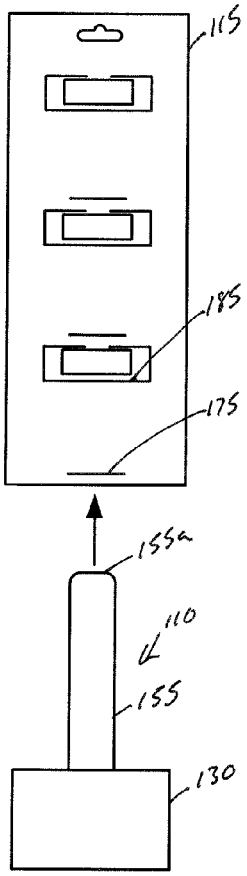
FIGS. 11 through 17 are a progression of images showing the positioning and attachment of envelopes and gift cards upon a backer panel.
Figure 12:
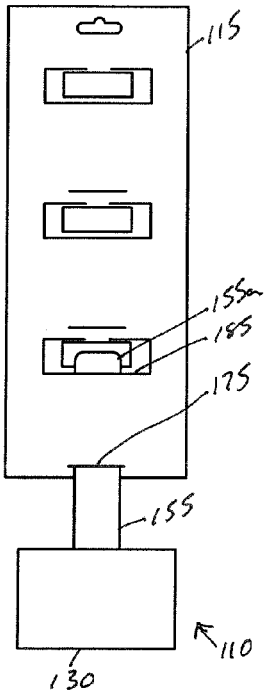

FIGS. 11 through 17 are a progression of images showing the positioning and attachment of envelopes 110 to the front subpanel 115*a* of the backer panel 115. FIG. 11 shows an envelope 110 with the tongue 155 extended and the distal end 155*a* positioned to enter the lower backer panel slit 175 of a backer panel 115 front subpanel 115*a*. The distal end 155*a* of the tongue 155 is inserted into the backer panel slit 175 and pushed upward until it emerges from the opening 185 that is formed between the lower margin of a cooperating tab 170 and the portion of the subpanel 115*a* proximate thereto. FIG. 12 shows the tongue 155 passed inward through the slit 175, along the underside of the front subpanel 115*a* of the backer panel 115, the distal end 155*a* then extending outward through opening 185.

Figure 13:
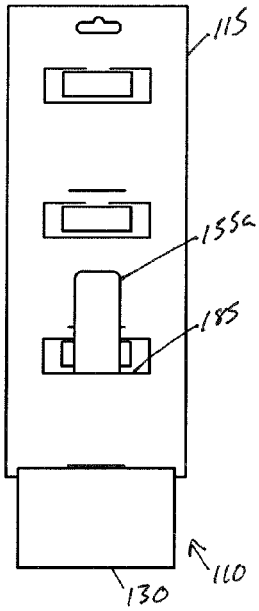
Figure 14:
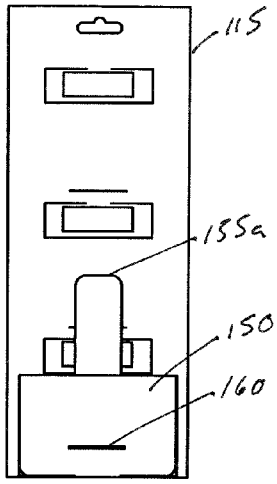
Figure 15:
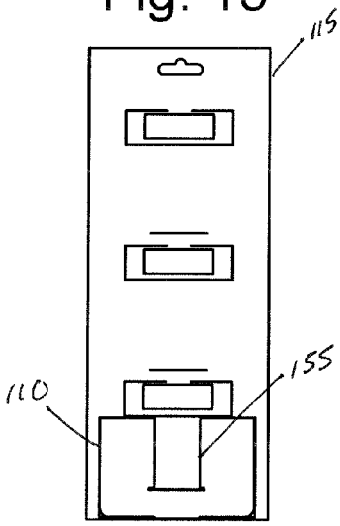

FIG. 13 shows the tongue 155 passed through slit 175 and opening 185, typically until the main body 111 abuts the edges of the slit 175. The main body 111 is flipped upward so that the top flap 150 now faces upward as shown in FIG. 14. The tongue 155 is then folded downward upon top flap 150 and the distal end 155*a* of the tongue 155 is inserted into the envelope slot 160 to secure the envelope 110 in a folded and closed disposition and to hold the envelope 110 in attachment to the backer panel 115.

Figure 16:
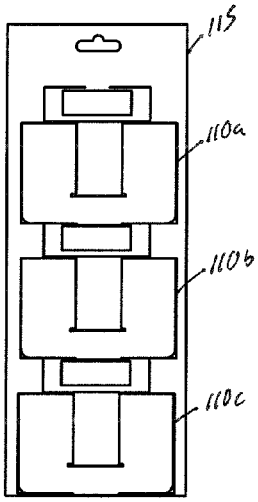
Figure 17:
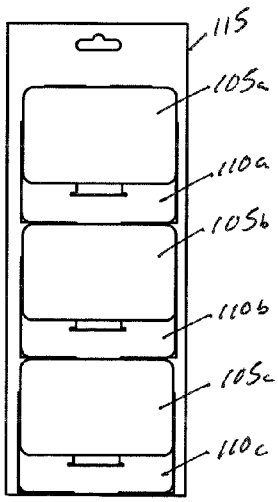

The above steps are repeated to attach envelopes 110 to all envelope positions on a backer panel 115. FIG. 16 shows multiple envelopes 110 attached to the backer panel 115, as occurs prior to subsequent attachment of cards 105 to the backer panel 115 and display of the holder assembly 100 for sale. FIG. 17 shows envelopes attached to all backer panel tabs 170.

Figure 18:
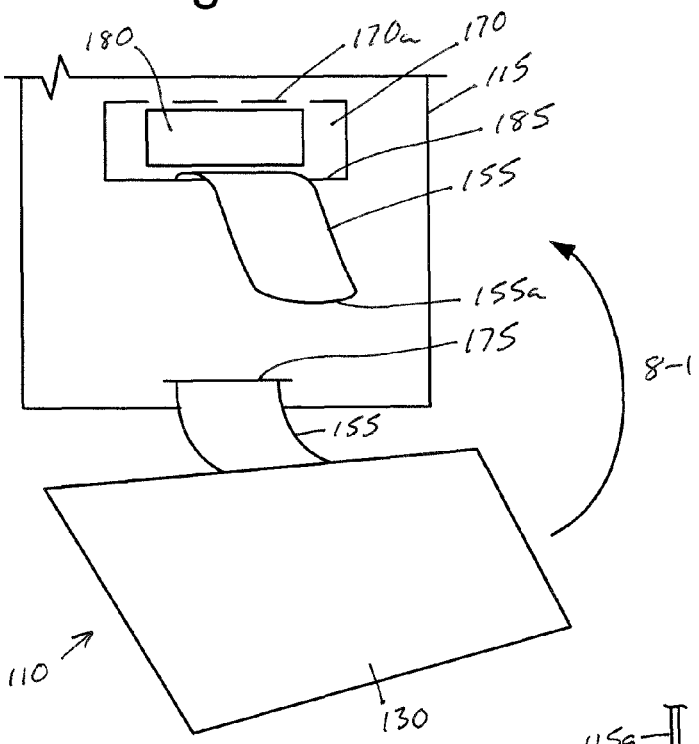
FIG. 18 is a perspective view of a backer panel and envelope showing the tongue of the envelope inserted into a backer panel slit and then passed through the opening formed by a cooperating/corresponding backer panel tab.
Figure 19:
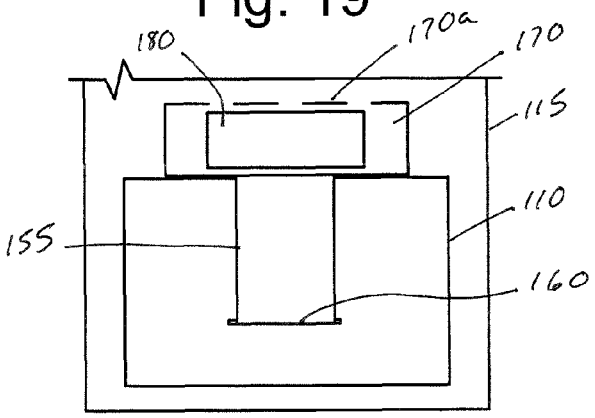
FIG. 19 is an elevation view showing the envelope attached to the backer panel.

FIG. 18 further illustrates attachment of an envelope 110 to a backer panel 115 and is a perspective view showing the tongue 155 inserted into a backer panel slit 175 and then passed back out through the opening 185. As indicated by arrow 8-1, the envelope 110 is then flipped or rotated upward to lie against the backer panel 115. As shown in FIG. 19, the tongue 155 is then inserted into the envelope slot 160.

Figure 4:
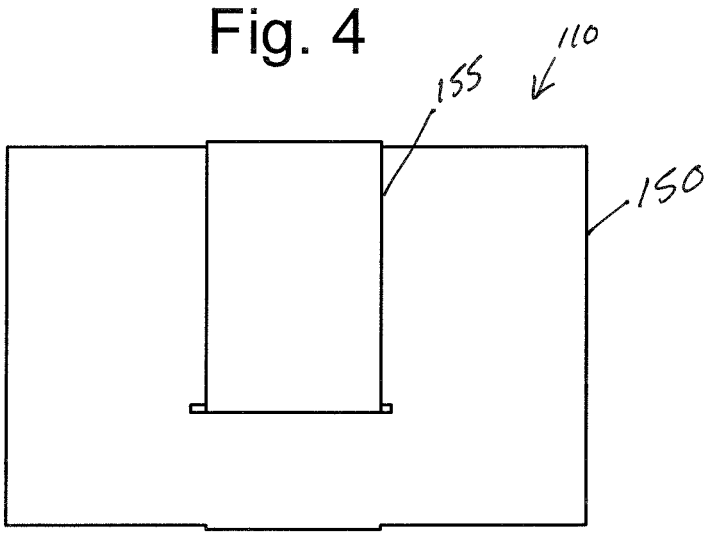
FIG. 4 is a is a front elevation view of an envelope in a fully folded disposition showing the envelope tongue inserted into the envelope slot to hold the envelope closed.
Figure 5:
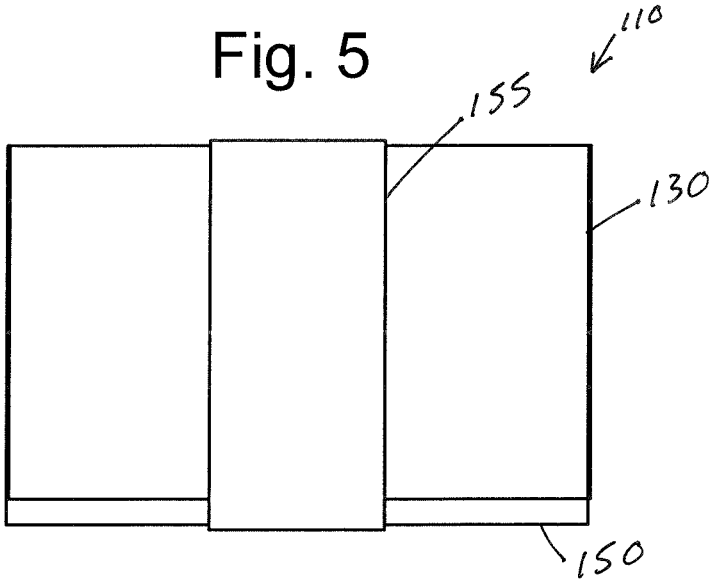
FIG. 5 is a rear elevation view of the envelope of FIG. 4.

After purchase of a card holder assembly 100, the purchaser typically removes the cards 105 and envelopes 110 and encloses each card 105 within an envelope 110. Returning to FIG. 3, placement of a transaction card 105 within an opened envelope 110 is indicated in phantom lines 105. After placement of card 105 upon the main panel 130, as shown, the side and bottom flaps 135, 140 and 145 are folded in upon the card 105 and the top flap 150 folded down upon the side and bottom flaps 135, 140 and 145. Turning to FIGS. 4 and 5, the tongue 155 may then be folded downward and the distal end 155*a* thereof inserted into the envelope slot 160 to place the envelope 110 in a fully closed position as shown in FIG. 4. FIG. 4 is a is a front elevation view of an envelope 110 in a fully folded disposition showing the tongue 155 inserted into the envelope slot 160 to hold the envelope 110 closed. FIG. 5 is a rear elevation view of the envelope 110. The envelope 110 is typically placed in such a closed disposition after a gift card or other transaction card 105 is placed therein and prior to presenting the envelope 110 bearing the card 105 to a recipient.

Figure 22:
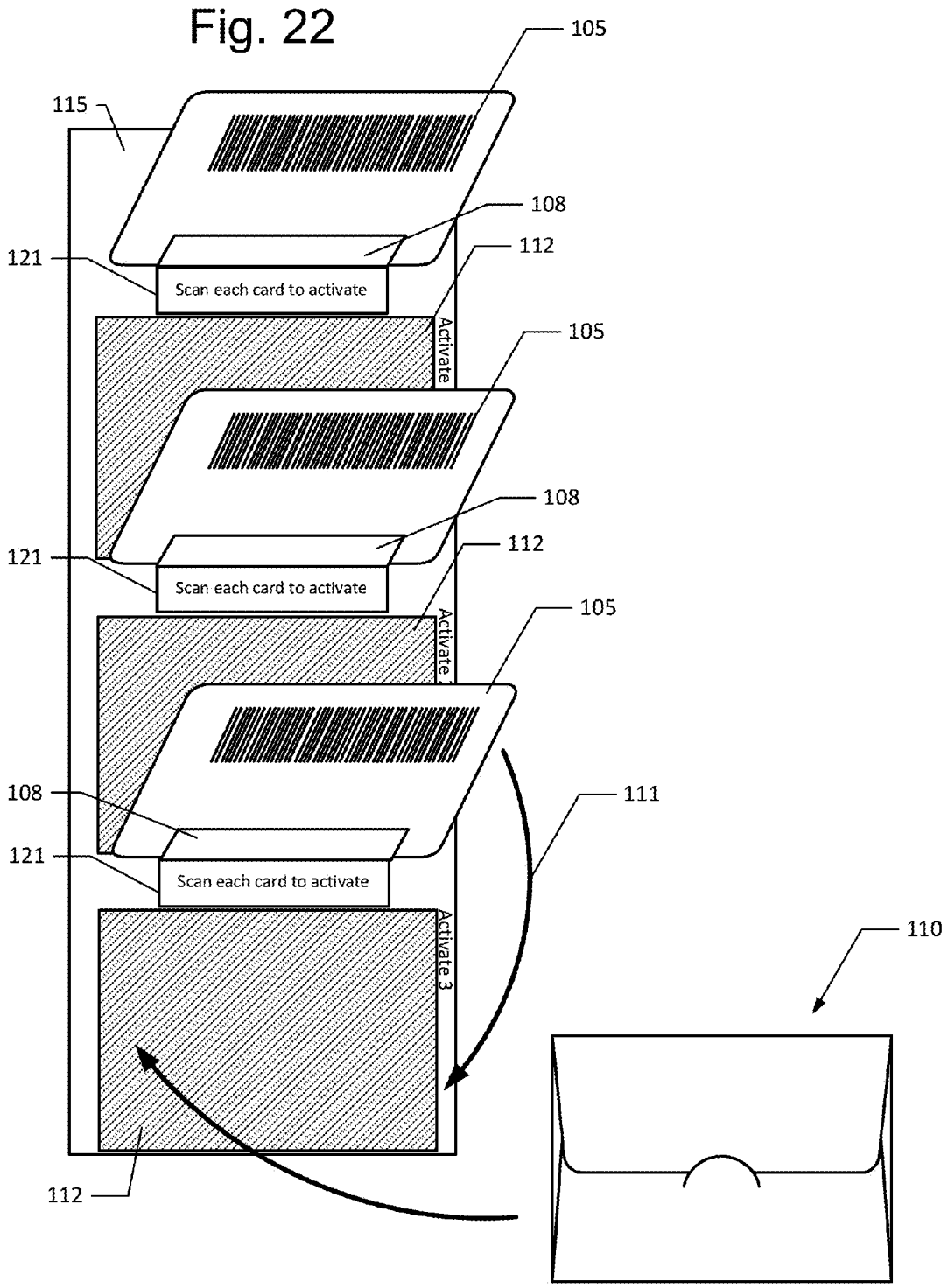
FIG. 22 is a diagram view showing transaction cards attached to backer panel tabs.
Figure 23:
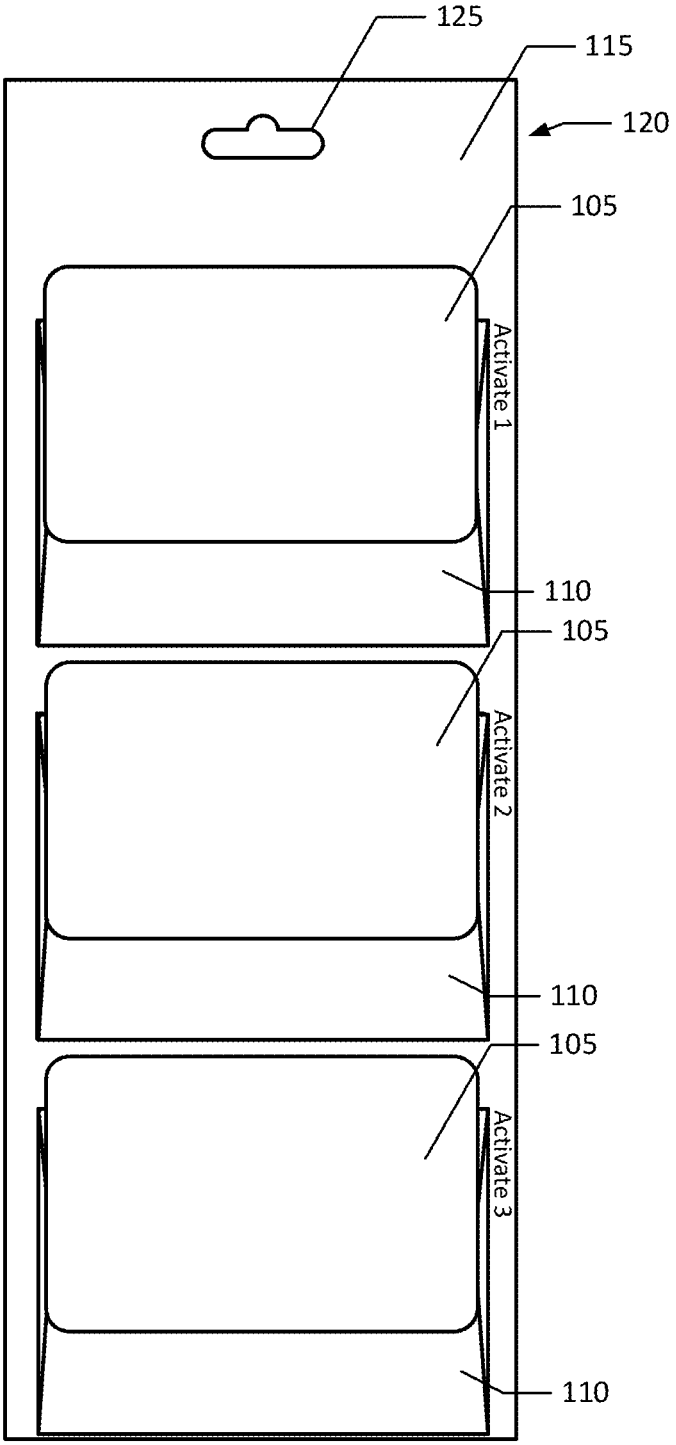
FIG. 23 is a front elevation view of transaction cards and envelopes attached to a backer panel.

FIGS. 22-26 illustrate another embodiment of a card holder assembly 100 for holding multiple transaction cards 105 (such as gift cards) and corresponding envelopes 110 for multiple scan activation. The holder assembly 100 includes a backer panel 115 to which the cards 105 and envelopes 110 are removably attached. FIG. 22 is a perspective view of a card holder 100 showing transaction cards 105 and envelopes 110 attached to the front surface of the backer panel 115. In particular, the cards 105 are shown removably engaged to hinged panel tabs 108. The hinged panel tabs 108 allow the cards 105 to be lifted and rotated towards or away from the backer panel 115, as generally indicated by 111. The backer panel 115 also includes one or more areas of adhesive 112 for removably engaging the envelopes 110 to the backer panel 115. FIG. 23 is a front rear elevation view of the holder assembly 100 showing the cards 105 and envelopes 110 attached to the front of the backer panel 115. As illustrated, the backer panel 115 includes an upper header portion 120 having a centrally located aperture or peg hole 125 for receiving the peg of a product display stand (not shown).

Figure 24:
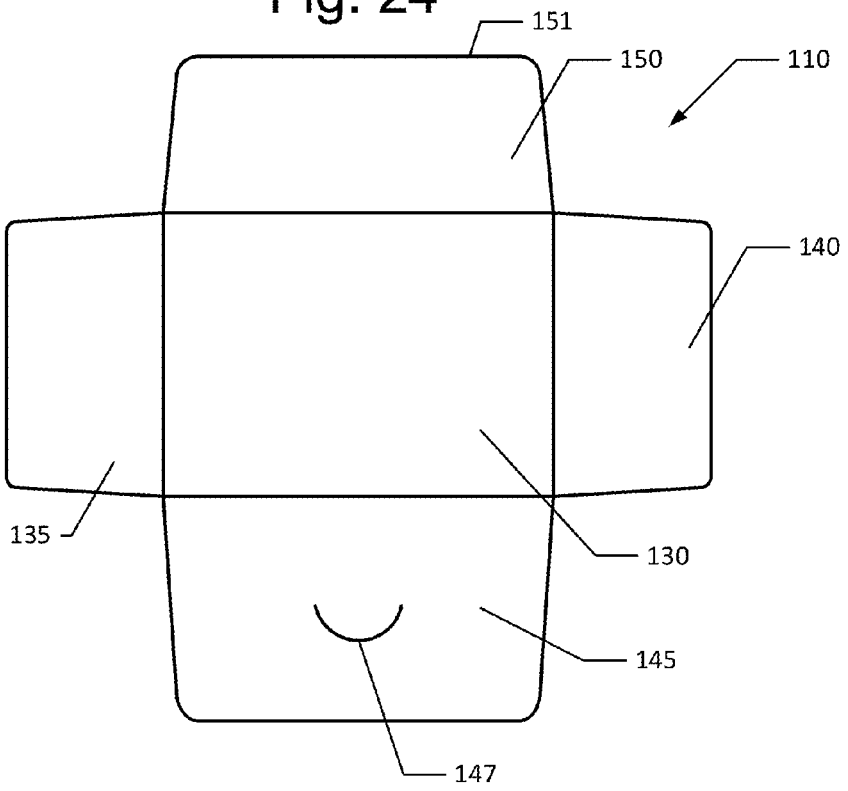
FIG. 24 is a plan view of an open envelope.
Figure 25:
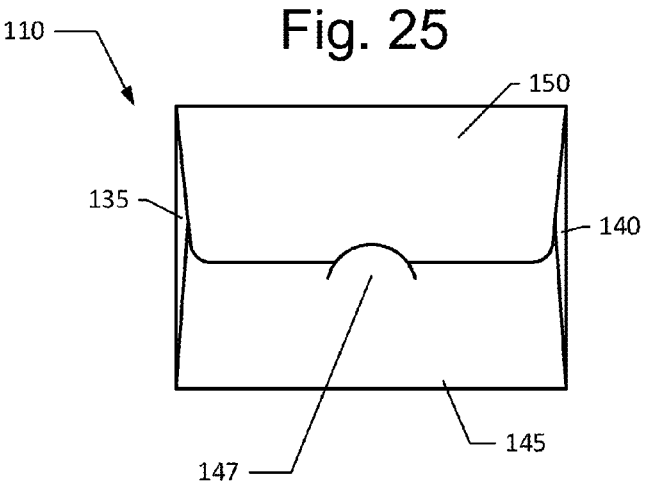
FIG. 25 is a plan view of a closed envelope.

FIGS. 24-25 show another embodiment of the envelope 110. This embodiment of the envelope 110 includes a main panel 130, a first side flap 135 projecting from the left margin of the main panel 130, a second side flap 140 projecting from the right margin of the main panel 130, a bottom flap 145 projecting from the bottom margin of the main panel 130, and a top flap 150 projecting from the top margin of the main panel 130.

The flaps 135, 140, 145 and 150 are hingedly connected to the main panel 130, typically via pre-scored fold lines therebetween, when the envelope 110 comprises a single piece of paper, card stock, or the like. The fold lines are typically formed by folding the flaps relative to the main panel 130 during assembly. The bottom flap 145 also includes a slot 147 for receiving the distal edge 151 of the top flap 150 after the envelope 110 is folded to secure the envelope 110 in a closed position.

Figure 26:
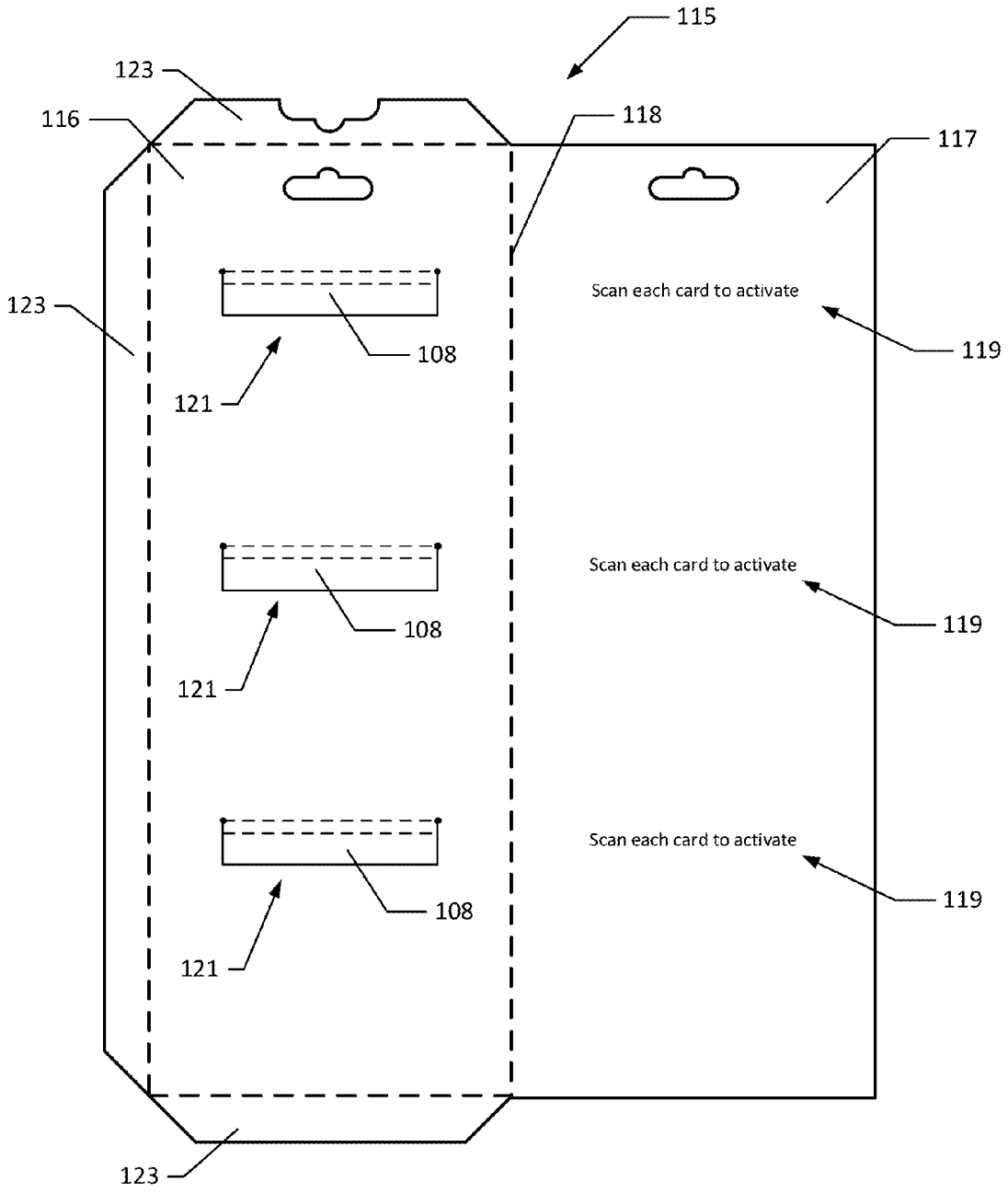
FIG. 26 is a top plan view of an unassembled backer panel used for multiple scan activation.

FIG. 26 is a top plan view of an embodiment of the backer panel 115 for multiple scan activation in an unassembled configuration. The unassembled backer panel, as shown, includes a first panel 116 and a second panel 117. FIG. 26 shows a rear view of the front panel 116 along with the hinged panel tabs 108. The second panel 117 of the backer panel 115 is rotated about a fold line 118 to be positioned atop the first panel 116. Indicia 119 printed on the second portion is thus visible through openings 121 formed by the hinged panel tabs 108.

As shown, the first panel 116 includes co-planar tab projections 123 extending away from the front panel. The tab projections are engaged to the front panel along fold lines. When assembled, the tab projections are folded along the fold lines to engage a back surface (not shown) of the second panel.

Figure 27:
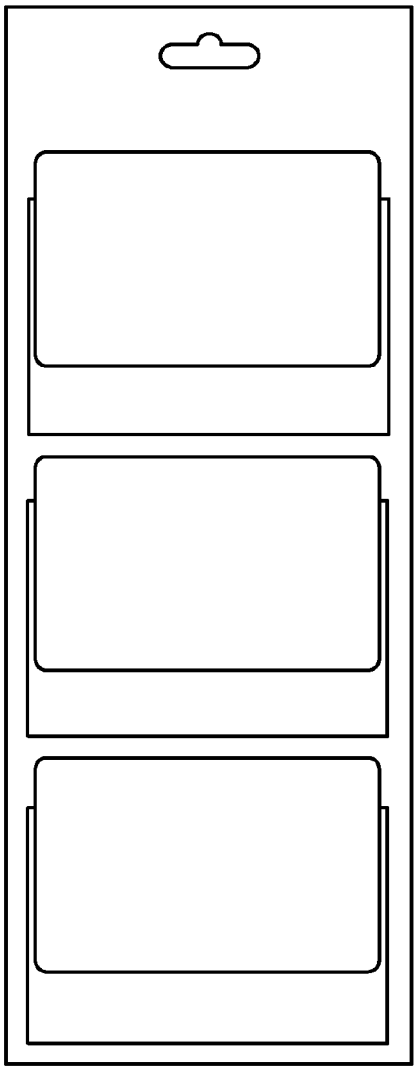
FIG. 27 is front elevation view of a backer panel used for single scan activation.
Figure 28:
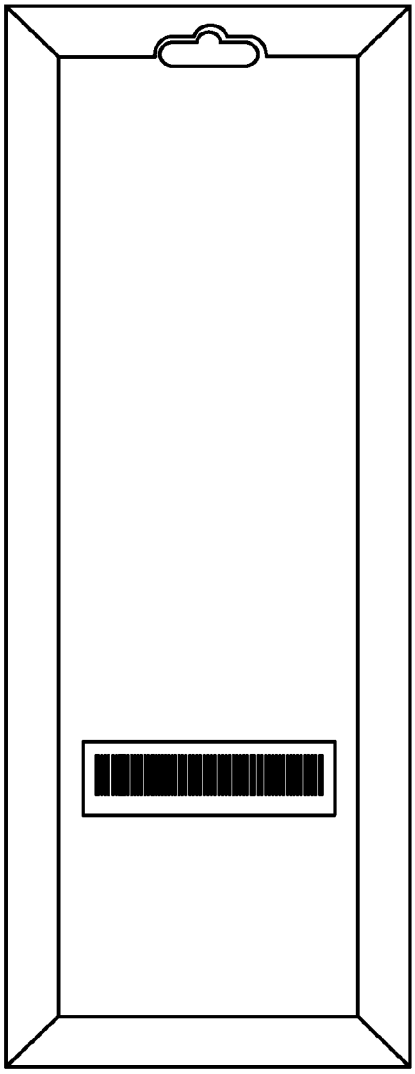
FIG. 28 is a rear elevation view of a backer panel used for single scan activation.
Figure 29:
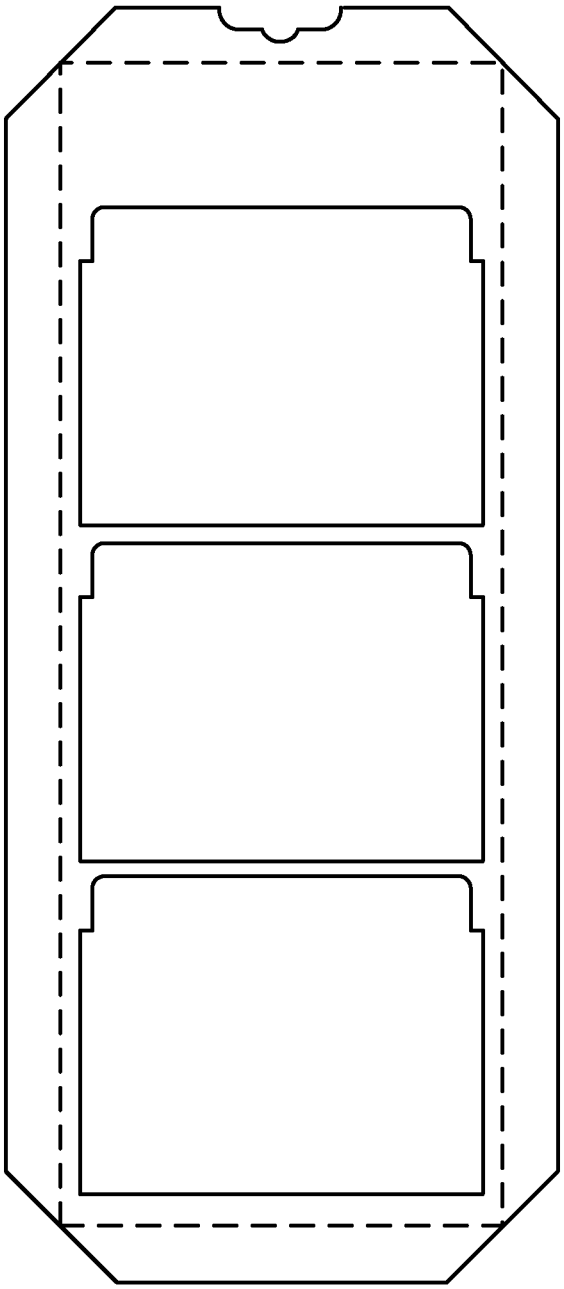
FIG. 29 is a top plan view of a clamshell cover typically comprising clear polyvinyl chloride.
Figure 30:
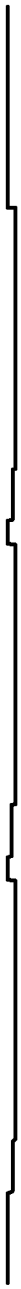
FIG. 30 is a cross sectional view of the cover of FIG. 29.

FIGS. 27 and 28 depict a complete card holder assembly that includes a clamshell cover enclosure, shown in FIGS. 29-30. The card holder assembly is substantially similar to the card holder assembly of FIGS. 1-23. In one aspect, the clamshell cover is transparent or at least translucent and may be composed of a polymer, including but not limited to molded polyvinyl chloride, acetate, or Polyethylene terephthalate glycol-modified (PETG). As shown in FIGS. 29-30, the clamshell cover is dimensioned to fit over the backer panel, as well as the engaged gift cards and envelopes. To fit on the backer panel, the clamshell cover defines one or more gift card holding regions and envelope holding regions. In one embodiment, the gift card holding regions and the envelope holding regions are stacked atop one another. In another embodiment, the gift card holding regions and the envelope holding regions may be separated from one another by a portion of the clamshell cover and/or the backer panel.

The clamshell cover includes co-planar tab projections extending away from the cover. The projections are hingedly engaged to the clamshell cover by folds in the clamshell cover. The tab projections extend beyond the portions of the clamshell surface that contact a front surface of the backer panel, indicated as the region bound by the fold lines.

To secure the clamshell cover to the card holder assembly, the tab projections are pivoted along the respective fold lines such that the projections engage the back surface of the backer panel as shown in FIG. 28.

In one embodiment, the clamshell cover prevents direct access to the gift cards; therefore, a single activation indicia is used to activate the gift cards. As shown in FIG. 28, the card holder assembly may include a single activation indicia printed on the back surface of the backer panel that may activate one or more of the gift cards associated with the card holder assembly. In another embodiment, the backer panel may define one or more openings that permit activation indicia on one or more of the gift cards to be visible or otherwise accessible through the backer panel, such that the gift cards may be activated when a clamshell cover is in place.

FIGS. 31-45 depict other embodiments of a card holder assembly. In one embodiment, the card holder assembly holds and displays one or more gift cards in an upper portion of the assembly, while a corresponding number of envelopes are stored in a lower portion. In various other embodiments, the portion for holding the envelopes may be above or next to the portion of the assembly for holding the gift cards.

Figure 31:
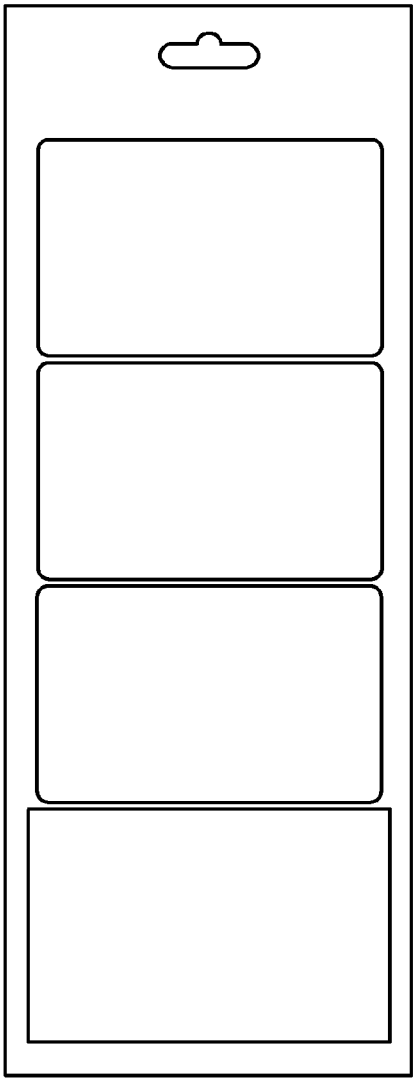
FIG. 31 is a front elevation view of a backer panel used for single scan activation showing envelopes held in stacked configuration at a bottom or lower portion of the backer panel.
Figure 32:
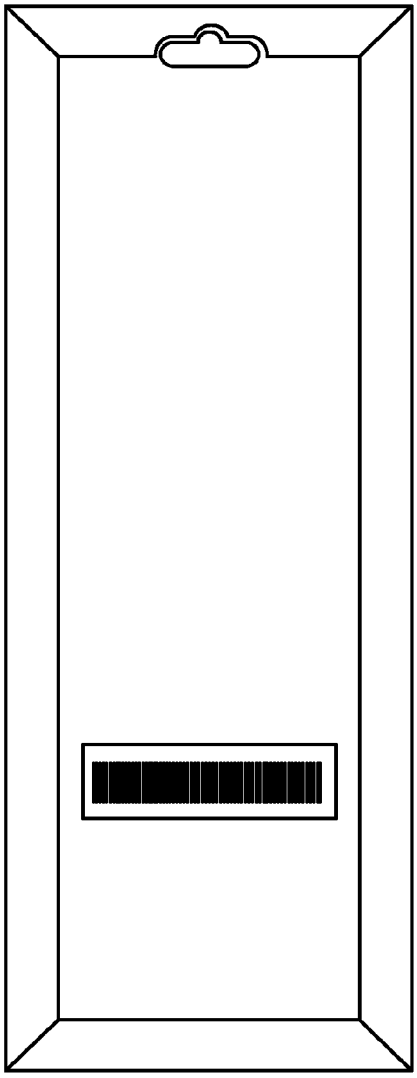
FIG. 32 is a rear elevation view of the backer panel of FIG. 31.

In one embodiment, the gift cards may be held individually in separate positions, as shown in FIG. 31. In various other embodiments, however, two or more gift cards may be stacked in the upper portion. For example, the gift cards may be stacked such that only the topmost card is visible. In another example, the gift cards may be in a fanned stack arrangement such that the topmost card is visible while only a portion of one or more remaining cards is visible. Other arrangements for displaying the gift cards may also be used.

Figure 33:
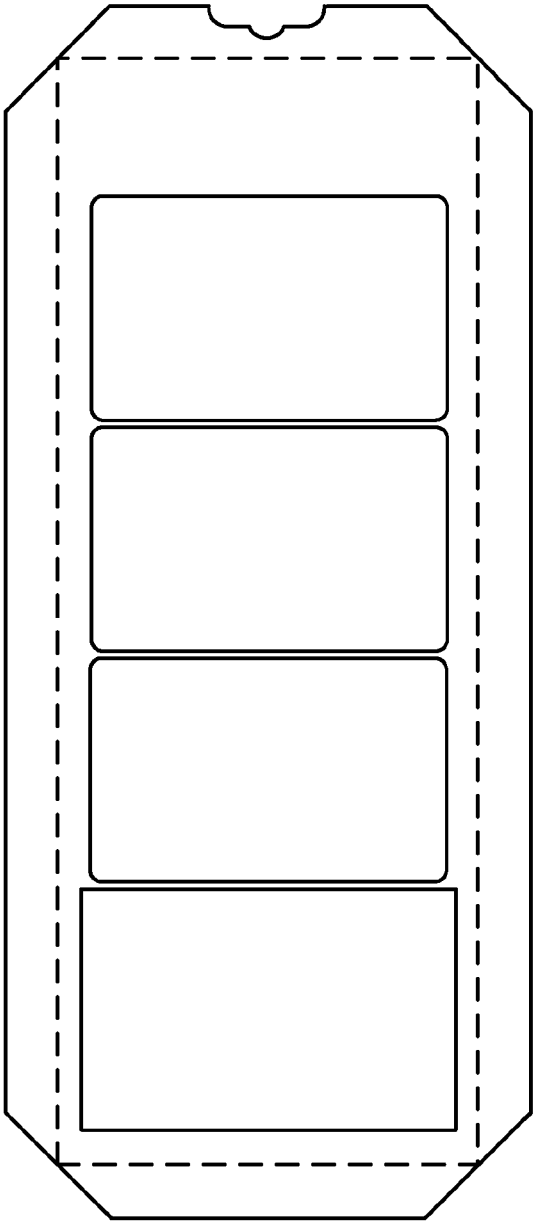
FIG. 33 is a top plan view of a clamshell cover typically comprising clear polyvinyl chloride.
Figure 34:
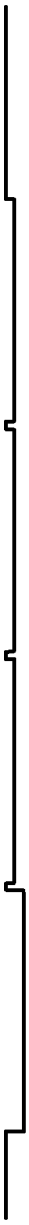
FIG. 34 is a cross sectional view of the cover of FIG. 33.
Figure 35:
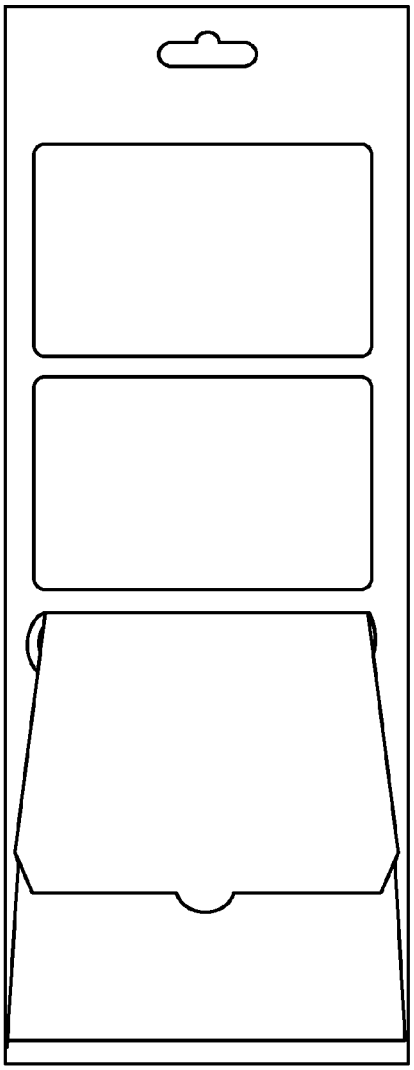
FIG. 35 is a front elevation view of a backer panel showing transaction cards held thereon and a purse-shaped transaction card holder mounted on a bottom or lower portion of the backer panel.

As shown in FIGS. 33 and 34, a clamshell cover similar to the clamshell cover shown in FIGS. 29 and 30, including similar coplanar projections and fold lines, may be engaged to the card holder assembly. The clamshell cover includes one or more distinct card holding portions and an envelope holding portion. As shown in one embodiment, the envelope holding portion is typically larger to accommodate a stack of envelopes corresponding to each gift card. However, in other embodiments, the envelopes may be held separately, in a fanned stack arrangement or in a fanned arrangement. Moreover, in yet another embodiment, the envelopes may be dimensioned to hold two or more gift cards, such that the number of envelopes provided with the card holder assembly may be less than the number of gift cards.

Figure 36:
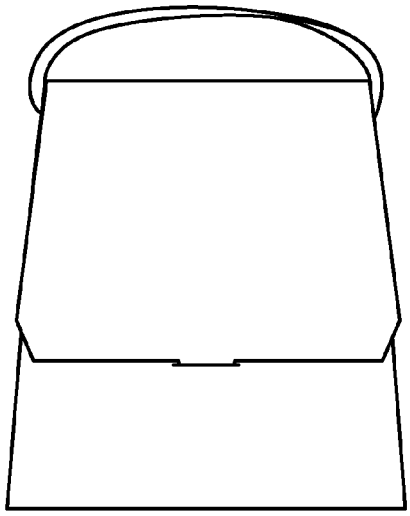
FIG. 36 is a front elevation view of the holder of FIG. 35 showing the holder flap closed.
Figure 44:
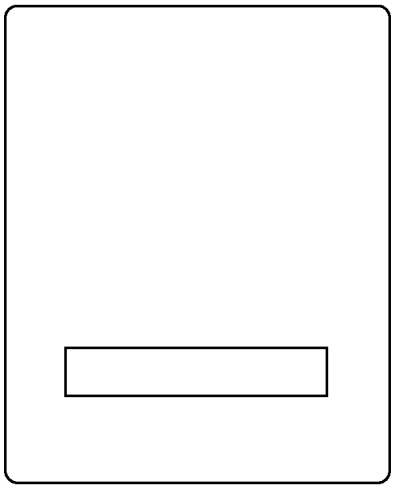
FIG. 44 is a front elevation view of a backer panel used for single or parent card activation.
Figure 45:
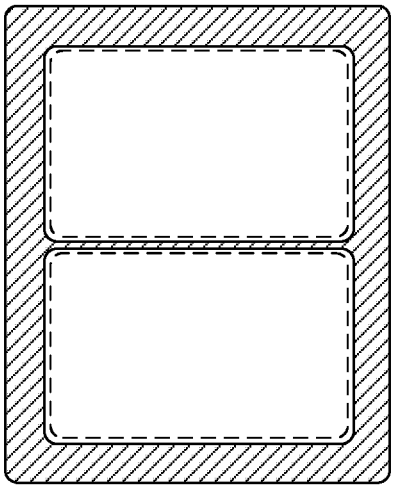
FIG. 45 is a rear view of a clamshell cover typically comprising clear, molded polyvinyl chloride, acetate, or PETG, the shaded portions indicating adhesive for adhering the cover to the backer panel of FIG. 44.

FIGS. 44 and 45 depict components of another embodiment of a single-activation card holder assembly. The backer panel defines an opening for single activation, wherein a single activation indicia is used to activate gift cards that may be attached to the backer panel. FIG. 36 depicts a clamshell cover that may be adhered to a backer panel. As shown, the clamshell cover may define a gift card holding region, an envelope holding region, and a peripheral region about the periphery of the clamshell cover that may receive an adhesive for attachment to the backer panel.

Figure 37:
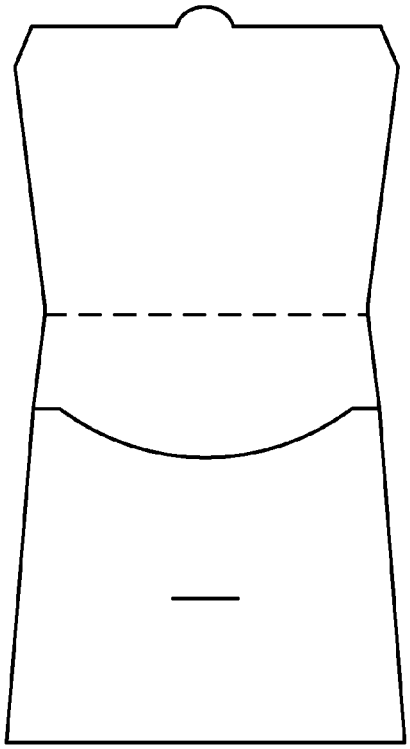
FIG. 37 is a front elevation view of the holder of FIGS. 35 and 36 showing the holder flap open.
Figure 38:
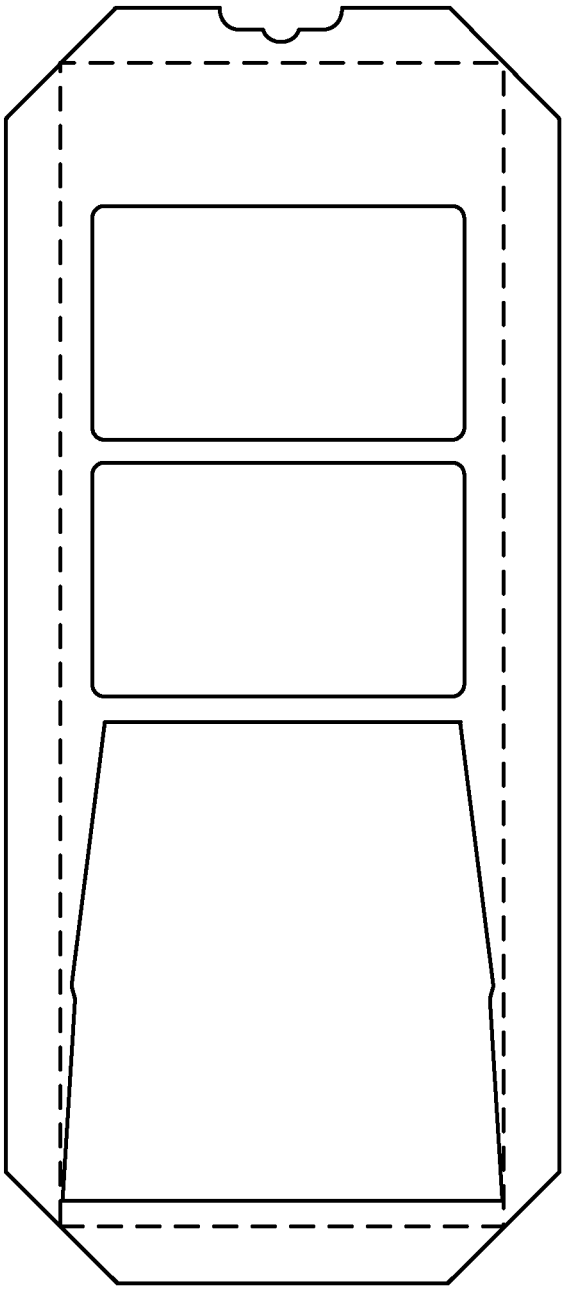
FIG. 38 is a top plan view of a clamshell cover typically comprising clear polyvinyl chloride.
Figure 39:
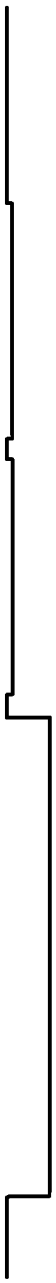
FIG. 39 is a cross sectional view of the cover of FIG. 38.

FIGS. 35-39 depict another embodiment of a card holder assembly. The card holder assembly is similar to the card holder assembly of FIGS. 31-34. However, the envelopes of this embodiment are shaped like a bag, such as a purse or gift bag, as shown in FIGS. 36-37. In one aspect, the bag-shaped envelopes are formed from a planar material, including but not limited to paper, cardstock, plastic, or any other suitable material, that is cut and scored or folded to form a bag shape. FIGS. 38-39 depict a clamshell cover. The clamshell cover includes a gift card holding portion and an envelope holding portion. The envelope holding portion is dimensioned to receive the bag-shaped envelopes.

FIG. 40 depicts a backer panel that defines an opening for single activations, wherein a single activation indicia is used to activate all of the gift cards attached to the backer panel. FIG. 42 depicts a clamshell cover that may be adhered to the backer panel. As shown, the clamshell cover may define one or more card holding portions, an envelope holding portion, and a peripheral region about the periphery of the clamshell cover that may receive an adhesive for attachment to the backer panel. FIG. 41 is a cross-sectional view of the clamshell cover shown in FIG. 42.

FIG. 43 depicts an example assembly process for providing a card holder assembly. As shown, one or more gift cards and envelopes are arranged and placed between a clamshell cover, having regions dimensioned to hold gift cards and envelopes, and, respectively, a backer panel. As shown, the backer panel is configured for single activation by defining an opening where activation indicia on one of the gift cards may be accessible through the opening. The clamshell cover may be attached to the backer panel through any suitable arrangement, including but not limited to an adhesive, staples, or by folding a portion of the clamshell portion to surround and engage a portion of the backer panel.

It should be appreciated that the holder assembly and its associated structures may be constructed in various shapes and forms and may bear various graphics and designs while maintaining the general structure and functionality described herein. For example, in various embodiments, the activation indicia may be printed on or affixed directly to the backer panel.

Figure 20:
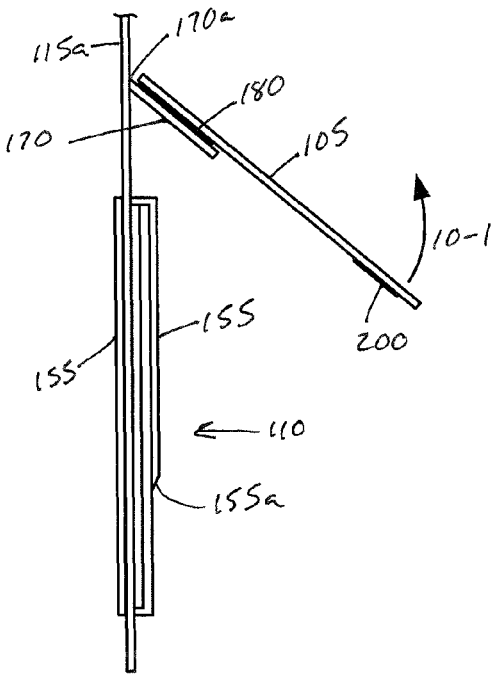
FIG. 20 is a partial, side, diagram view showing the transaction card lifted away from the front subpanel of the backer panel in order to reveal a magnetic strip on the rear surface of the card for scanning.
Figure 21:
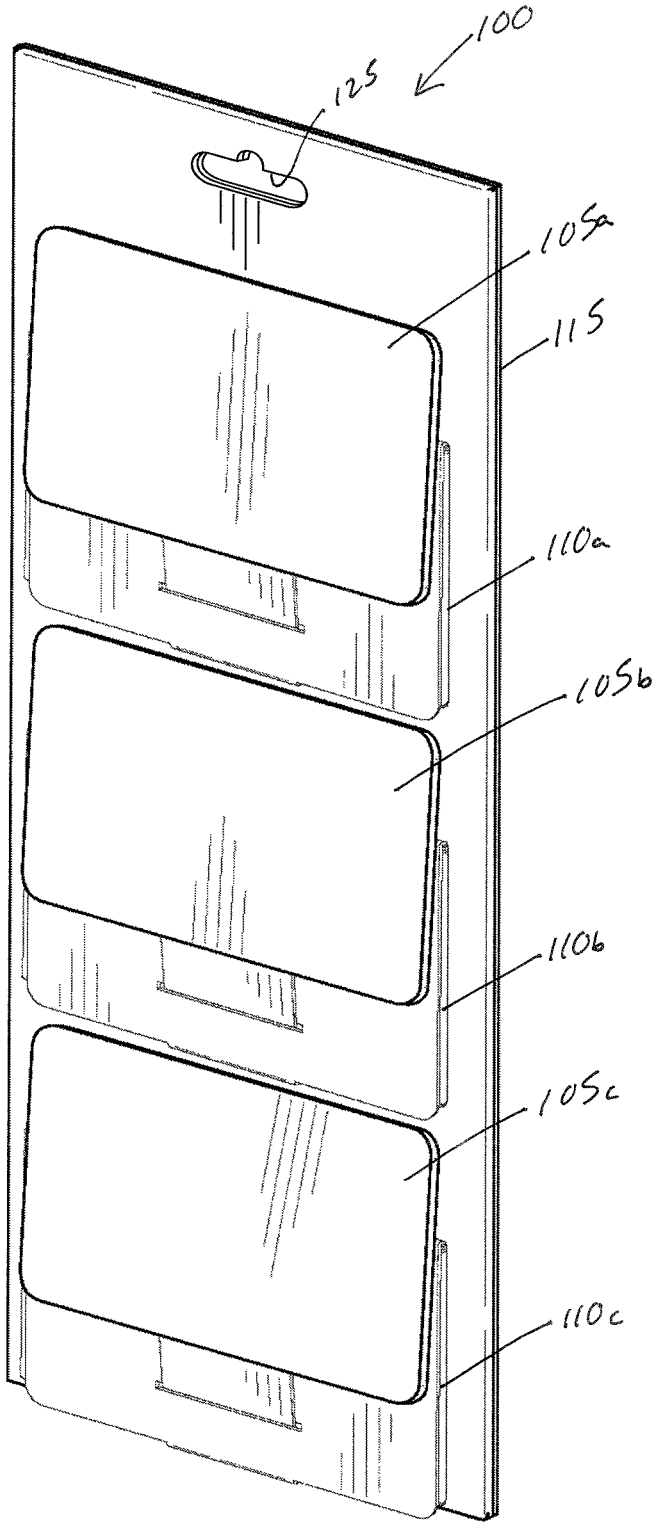
FIG. 21 is a perspective view of a holder showing envelopes and transaction cards attached to the front surface of the backer panel.

FIG. 20 is a partial, side, diagram view showing the transaction card 105 lifted away in the direction of arrow 10-1 from the front subpanel 115*a* of the backer panel (the rear subpanel is omitted for clarity) in order to reveal a magnetic strip 200 on the rear surface of the card and make it accessible for scanning without the necessity of removing the card 105 from the assembly 100. In certain embodiments the magnetic strip 200 of each card 105 is scanned individually at the point of sale to activate, while in other embodiments scanning a bar code or UPC code (???) typically provided on the surface of the backer panel 115 or packaging activates all cards 105 in the assembly 100. In still further embodiments, scanning the magnetic strip 200 of any one of the cards 105 of the assembly 100 activates all cards 105 of the assembly 100.

It should be appreciated that the holder assembly 100 and its associated structures may be constructed in various shapes and forms and bearing various graphics and designs while maintaining the general structure and functionality described herein.

The invention claimed is:

1. A card holder assembly for holding multiple transaction cards to an elongated backer panel, the card holder assembly comprising:

the elongated backer panel, wherein the elongated backer panel further comprises:

a plurality of backer panel tabs;

a plurality of activation apertures to access activation information;

a plurality of transaction cards, wherein each of the plurality of cards is removably engaged to a corresponding backer panel tab of the plurality of backer panel tabs; and a plurality of envelopes removably engaged to the elongated backer panel; wherein each of the plurality of envelopes is disposed under a corresponding transaction card of the plurality of transaction cards.

2. The card holder assembly of claim 1 wherein the plurality of activation apertures permit access to activation information on at least one transaction card of the plurality of transaction cards engaged to the plurality of backer panel tabs.

3. The card holder assembly of claim 2, wherein the activation information is machine-readable to activate the at least one transaction card.

4. The card holder assembly of claim 3, wherein the activation information comprises a magnetic strip or a bar code.

5. The card holder assembly of claim 1 wherein the elongated backer panel comprises:

a first panel hingedly engaged to a second panel, wherein the first panel comprises the plurality of backer panel tabs and the plurality of activation apertures; and wherein the second panel comprises indicia aligned with the plurality of activation apertures when the second panel is disposed atop the first panel in an assembled configuration.

6. The card holder assembly of claim 5, wherein the first panel further comprises co-planar tab projections extending away from the front panel; wherein the co-planar tab projections engage an exterior facing surface of the second panel in the assembled configuration.

7. The card holder assembly of claim 1 further comprising a cover enclosure defining at least one transaction card portion dimensioned to cover at least one transaction card and corresponding envelope; wherein the cover enclosure is engaged to the elongated backer panel.

8. The card holder assembly of claim 7, wherein the cover enclosure is transparent.

9. The card holder assembly of claim 7, wherein the cover enclosure has at least one of a cover length or a cover width greater than a corresponding backer panel length or backer panel width, such that at least a portion of the cover enclosure wraps around the elongated backer panel and contacts a back surface thereof.

10. The card holder assembly of claim 7, wherein the cover enclosure is engaged to the elongated backer panel by an adhesive.

11. The card holder assembly of claim 10, wherein the adhesive is placed around a periphery of the cover enclosure.

12. The card holder assembly of claim 7 wherein the at least one transaction card portion is dimensioned to hold two or more transaction cards and corresponding envelopes.

* * * * *